US006293876B1

(12) United States Patent
Hahn De Bykhovetz et al.

(10) Patent No.: US 6,293,876 B1
(45) Date of Patent: Sep. 25, 2001

(54) IRON CATEGORY GOLF CLUB AND GOLF CLUB SET

(75) Inventors: Nicolas Hahn De Bykhovetz, 200 rue de Rivoli, F-75001 Paris; Saïd Carto, Sevres, both of (FR)

(73) Assignee: Nicolas Hahn De Bykhovetz, Paris (FR)

( * ) Notice: Subject to any disclaimer, the term of this patent is extended or adjusted under 35 U.S.C. 154(b) by 0 days.

(21) Appl. No.: 08/331,541

(22) PCT Filed: May 6, 1993

(86) PCT No.: PCT/FR93/00439

§ 371 Date: Nov. 3, 1994

§ 102(e) Date: Nov. 3, 1994

(87) PCT Pub. No.: WO93/22006

PCT Pub. Date: Nov. 11, 1993

(30) Foreign Application Priority Data

May 6, 1992 (FR) ..... 92 05589

(51) Int. Cl.[7] ..... A63B 53/04

(52) U.S. Cl. ..... 473/287; 473/289; 473/290; 473/316; 473/324

(58) Field of Search ..... 273/167 R, 77 A, 273/169, 167 F, 167 H, 77 R, 193 R, 194 R, 164.1, 171; 473/287, 289, 290, 316, 350, 324

(56) References Cited

U.S. PATENT DOCUMENTS

| | | | | |
|---|---|---|---|---|
| 3,416,797 | * | 12/1968 | Pfau . | |
| 4,784,390 | | 11/1988 | Horgen . | |
| 4,840,380 | * | 6/1989 | Kajita | 273/77 A |
| 4,869,507 | * | 9/1989 | Sahm . | |
| 4,872,683 | * | 10/1989 | Doran . | |
| 4,971,321 | | 11/1990 | Davis . | |
| 5,133,553 | * | 7/1992 | Divnick . | |

FOREIGN PATENT DOCUMENTS

| | | |
|---|---|---|
| 2227179 | 7/1990 | (GB) . |
| WO 92/14519 | 9/1992 | (WO) . |

OTHER PUBLICATIONS

By C. Paul, "Golf Clubmaking and Repair", 1984, pp. 3, 193–194, 291, 299, 344, 346–348, 363–364, 396, 456–457, 468–469, Austin, Texas.

* cited by examiner

*Primary Examiner*—Sebastiano Passaniti
(74) *Attorney, Agent, or Firm*—Young & Thompson

(57) ABSTRACT

The golf club has a length over 0.99 m, a loft angle of at least 35°, a head mass of about 0.260 kg or less, and a lie angle of less than 60°. The golf club allows long and high slots.

18 Claims, 1 Drawing Sheet

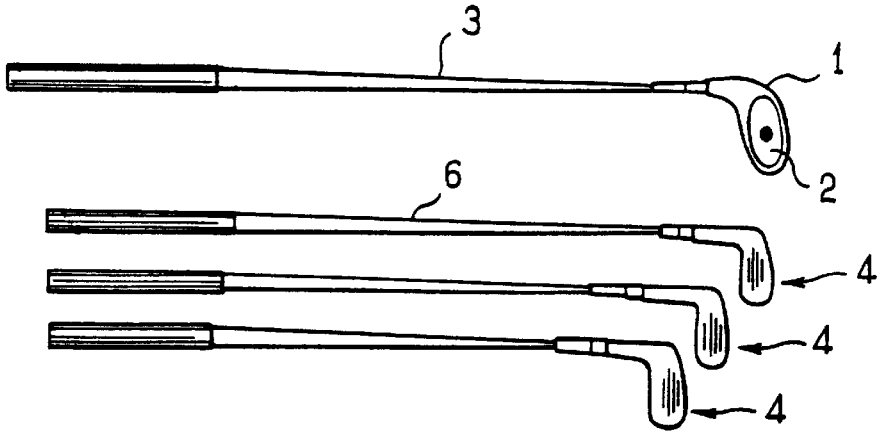
FIG_1
FIG_2
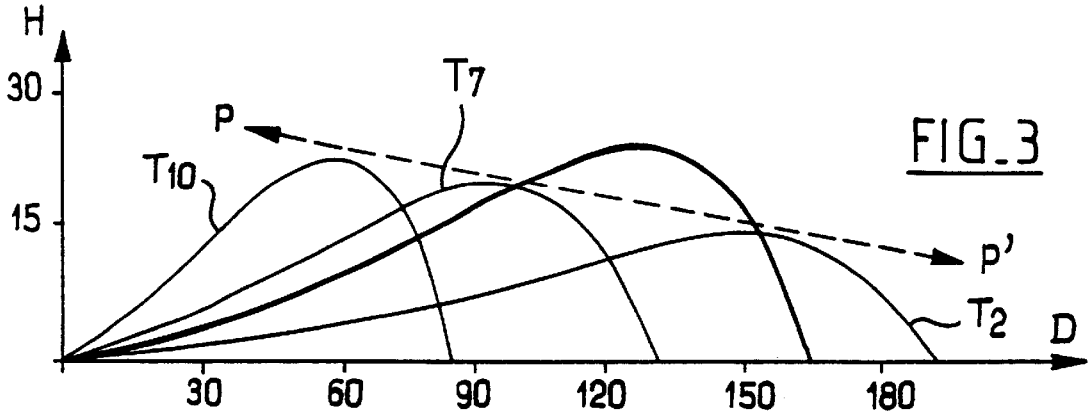
FIG_3
FIG_4
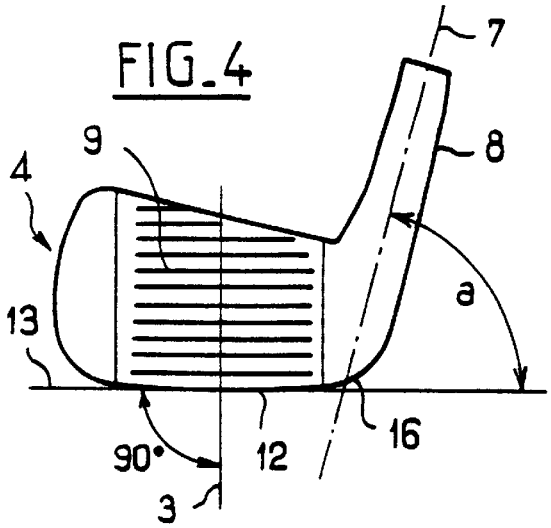
FIG_5
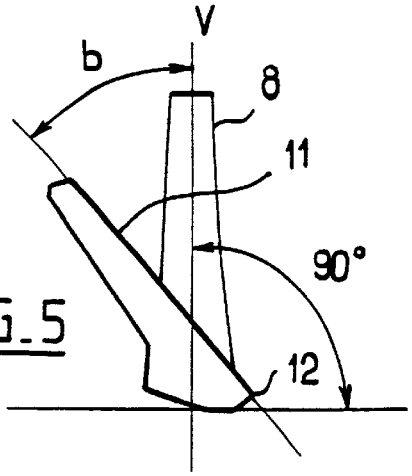
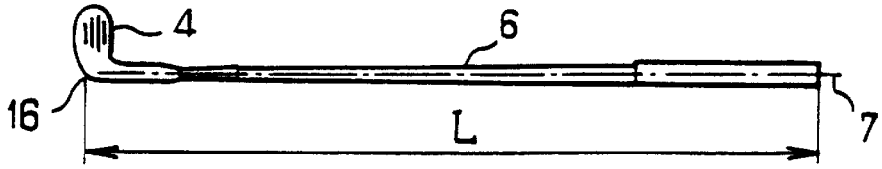
FIG_6

IRON CATEGORY GOLF CLUB AND GOLF CLUB SET

FIELD OF THE INVENTION

The present invention relates to a golf club belonging to the category of "Irons".

BACKGROUND OF THE INVENTION

The present invention also relates to a golf club set.

State of the prior art "Iron" type golf clubs have a shaft to which a head with a generally four-sided shape is fixed, having a striking face forming a certain angle, or "face angle" ("loft") with a plane containing the shaft axis, and parallel to the lower edge of the striking face. Moreover, said lower edge forms a certain angle, or "lie", with the shaft axis.

The face angle is chosen to be as large as one desires in order to manufacture a club which produces high and short trajectories. In this case, the shaft is relatively short and the mass of the head is chosen to be relatively high. On the contrary, with a small face angle, a long shaft and a light mass, the kinetic energy of impact on the ball produces a long and low trajectory. For decades thinking on this subject has been locked into this logic. This is why the construction of modern "Irons" has been codified for the last half-century in such a way that the player must choose between playing a ball high but short, or on the other hand playing a ball long but low.

In fact, until now, the complete series of commercially-available irons, which are usually numbered from 1 Iron to 9 Iron, "Pitching Wedge" (or 10 Iron) and "Sand-Wedge" are all designed in such a way that an increasing face angle ("loft") corresponds to an increasing surface, volume and weight of the club head, and a decreasing length of shaft.

Thus the 1 Iron will have the longest shaft of the irons in the bag (approx. 1.05 m), and the smallest face angle, about 18°, i.e. a virtually vertical striking face; it will produce the longest (200 m) and lowest (12 m) trajectories, the ball running on furthest after its flight. At the other end of the scale, a "Sand-Wedge" Iron will have a significantly shorter shaft (approx. 0.89 m), a heavier head, with a larger striking face which is very inclined (about 56°) and will produce the shortest (80 m) and highest (25 m) trajectories, the ball stopping almost immediately after hitting the ground.

The shaft length plays an important role. The longer the shaft the greater the muscle power required to give the club a specific angular velocity when the ball is struck. But for a given angular velocity, the velocity of the head increases proportionally to the length of the shaft. The kinetic energy imparted to the ball, which is proportional to the square of the velocity at the moment of impact, is therefore, for a given angular velocity, proportional to the square of the shaft length.

These considerations and others, connected with the experience and physical stamina of players, has led to the classic set of "Irons" mentioned above being preferred.

It should be noted that the lengths in question are those envisaged for a male of average height, i.e. between 1.7 m and 1.8 m.

For a woman of average height, this being between about 1.55 m and 1.65 m, the length of the "Iron" of the same number is reduced by one inch, i.e. about 2.5 cm.

The lie angle is such that the lower edge of the striking face rests horizontally on the ground when the club rests on the ground while being gripped in a normal manner by a person being of the height for which the club was designed.

As the shaft length varies according to the height of the persons for whom each club is intended, the lie angle can be substantially independent of the person's height.

With state-of-the-art Irons, the player who is preparing to play the ball knows that he stands along the vertical axis of a conical space, the base of which is adjacent to the ground, and that the ball is not able to go beyond this conical space. Either the ball is played high and will remain relatively close to the axis or the ball is played long and the maximum altitude of its trajectory is reduced. Moreover, this appears to be logical.

Now, in numerous situations in play, golfers may wish to play a ball both long and high with the precision of an "iron", for example to clear a high and fairly distant obstacle without going too far past it, or to get out of moderately thick rough with a shot of power and distance, or to get out of a fairway bunker (sand trap) which has an elevated rim with a long shot, or to hit the green on certain "Par 3" holes . . .

In some of these cases, it would be possible for a good player using another type of club, the category of "lofted" fairway "Woods" (4 to 7 wood), to play a ball that is both long and high. However, in practice, the majority of golfers dread using these "fairway Woods", which are trickier to play than the Irons in many situations, and above all more difficult to play with precision (greater risks of lateral spread).

SUMMARY OF THE INVENTION

The aim of the present invention is to propose a golf club which offers new possibilities, in particular for clearing relatively high and distant obstacles with precision.

According to the invention the iron category golf club comprising a shaft to the one end of which is fixed a head having a striking face forming a face angle with a plane containing the shaft axis and approximately parallel to the lower edge of the striking face, is characterized in that its face angle is greater than 31° and in that the length of the club measured along the shaft axis is greater than a value calculated according to the norms of the profession on the basis of 0.98 m, or even 0.99 m (preferred value), for a club intended for a man whose height is about 1.75 m.

According to another definition based on the same inventive concept, the iron category golf club comprising a shaft to one end of which is fixed a head having a striking face forming a face angle with a plane containing the shaft axis and parallel to a lower edge of the striking face, while the shaft axis forms a lie angle with the lower edge of the striking face, is characterized in that its face angle is greater than 33.5° and in that the lie angle is less than or equal to 59°,(preferred value). The face angle can also be greater than 35° in combination with a lie angle less than 60°.

Preferably, if the shaft is made of a high specification metal, the mass of the head is less than 0.255 kg, and if the shaft is made of composite material, the mass of the head is less than 0.260 kg. In any case, a mass less than 0.275 kg will generally be respected. The preferred value is 0.245 kg.

Advantageously, the face angle can be greater than 33.5° or even 35°. The preferred value is 36.5°.

In a surprising fashion the golf clubs according to the invention allow performances to be achieved which may be qualified as extraordinary relative to those achieved with known irons. In particular, a ball played with a club according to the invention is capable of clearly exceeding the conical space mentioned above.

More particularly, balls played in this way have the precision of "Irons" whilst at the same time being able to be played longer and higher.

According to another aspect, the invention relates to a set of iron category golf club, each comprising a shaft to one end of which is fixed a head having a striking face forming a face angle with the plane containing the shaft axis and parallel to the lower edge of the striking face, this set containing a series of clubs the respective lengths of which measured along the shaft axis vary inversely to the face angles, characterized in that in addition the set contains an additional club whose face angle is greater than 31° and whose length is within the length range of clubs of the series whose face angle is between 15° and 26°, and preferably corresponds approximately to the length of a club of the series whose face angle is about 20°.

The mass and the lie angle of the head of the additional club are preferably in the mass and lie angle ranges for club heads of the series whose face angle is between 15° and 26°.

Other characteristics and advantages of the invention will also emerge from the description given hereafter which relates to non-limitative examples.

BRIEF DESCRIPTION OF THE DRAWINGS

In the attached drawings:

FIG. 1 is a plan view of a "wood" category club according to the state of the art;

FIG. 2 is a plan view of a range of "Iron" category clubs according to the state of the art;

FIG. 3 is a diagram showing the trajectories of different balls played with different irons;

FIGS. 4 and 5 are a front view and an end/side view respectively of the head of an iron according to the invention;

FIG. 6 is a plan view of a club according to the invention.

DETAILED DESCRIPTION OF THE INVENTION

As is shown in FIG. 1, a so-called "wood" club comprises a head 1 made of wood, metal or composite material, with an ovoidal shape with a recess 2 in the striking zone. The head 1 is attached to a shaft 3. Generally, the woods have longer shafts than the irons.

Their trajectories range from the longest (No. 1 Wood or Driver) to average lengths and average heights (No. 5 to No. 7 Wood). They are considered by the majority of players as the most difficult to master. The Woods which are played most frequently are the No. 1 to No. 5 Woods.

FIG. 2 represents a set of "Irons" arranged according to shaft length and of decreasing power, i.e. ranging from the No. 1 Iron to the No. 10 Iron and to the "Sand-Wedge".

They are played from the fairway and around the aprons of each hole. Golfers use them frequently and generally expect greater precision from them than from Woods. The heads 4 of the Irons are generally made of metal, but more and more are made of composite materials. The head 4 is attached to a shaft 6 which can also be of metal or of composite material.

In the case of metal materials, they are, in the case of the invention, high specification metals which in particular allow the shaft to withstand the power of the shots permitted by the club without the weight of the shaft becoming prohibitive.

If the shaft was too heavy, it would be necessary to lighten the weight of the head so that the total weight of the club remains acceptable in relation to the abilities and muscle power of the player. Now, a club whose head is lighter than the shaft is badly balanced and difficult to play with.

By high specification metals is meant, in particular, a steel with greater strength than ordinary steel, or an alloy of aluminium or of titanium.

In order to lighten the shaft it can be advantageously produced in a tubular form.

FIG. 3 shows the trajectories of balls. The abscissa corresponds to the horizontal distances D relative to the position of the player. The ordinate H corresponds to the altitudes.

Present-day irons produce high and short trajectories for the "short" irons (with high numbers), for example, the trajectory T10 for the 10 Iron (Pitching-Wedge), trajectories of medium height and length for the intermediate Irons, for example, trajectory T7 for the 7 Iron, or also long and low trajectories for the long Irons, for example, trajectory T2 for the 2 Iron. The height limit of the trajectories of irons belonging to all the classic sets shown by the line PP', should be noted, which decreases in a homogeneous and progressive fashion from the "short" irons to the "long" irons.

The line PP' constitutes the generator of a cone the vertical axis of which is the axis of ordinates and the trajectories obtained with known irons are all situated inside this cone.

As shown in FIGS. 4 and 5, the head 4 of an "Iron" club comprises a socket area 8 defining the shaft axis 7 and a grooved striking area 9 connected in a monobloc fashion with the socket area 8. The grooved striking area 9 includes a striking face 11 which is of general plane shape and has a lower edge which is approximately rectilinear 12 which is adjacent to and parallel with the ground 13 at the moment the ball is struck.

The lie angle a of the club is defined by the angle formed by the axis 7 of the shaft 6 with the horizontal plane 8, when the club is held in the "address" position, i.e. with the median line 14 of the face 11 situated in a vertical plane (by manufacture the grooves provided on the striking face 11 are then horizontal). In a current set of irons, the angle a varies from approximately 56° (1 Iron) to 66° (Sand-Wedge Iron).

The lie angle a may also be defined as the angle between the axis 7 and the edge 12, i.e. if the axis 7 and the edge 12 do not intersect, then the angle is defined as between the axis 7 and a line parallel to the edge 12 which does intersect the axis 7.

The face angle b of the club ("loft") is defined by the angle formed by the plane of the striking face 11 with a vertical plane V, when the club is held in the "address" position with the shaft axis in the vertical plane (here, the axis 7 and the plane V are merged). The face angle can also be defined as the angle between the striking face 11 and a plane containing the shaft axis 7 and parallel to the lower edge 12 of the striking face 11. In all commercially-available sets of irons, the face angle varies from about 18° (1 Iron) to 56° or more (Sand-Wedge. Iron).

According to the invention, the iron-type golf club has the following characteristics, noted here for a male player of average height (1.70 to 1.80 m) and which will vary in size according to the standards of the profession for women and children as well as for different morphologies.

The length L of the club (FIG. 6), measured along the axis 7 of the shaft 6, i.e. between the heel 16 of the head 4 and the end 17 of the shaft 6: greater than 0.96 m and preferably greater than 0.98 m.

Face angle b: more than 31°, preferably more than 33.5°, or even more than 35°.

Lie angle a: less than 62°, or preferably less than or equal to 60°.

Head mass (new head, plain, ready to mount): less than 0.275 kg, and preferably less than 0.255 kg if the shaft is made of high-specification metal and less than 0.260 kg in the case of a shaft constructed of composite material, which is lighter and therefore requires increasing, by a small amount, the head mass relative to a metal shaft.

Surface of the striking face 11: intermediate between that of a traditional 7 Iron and that of a traditional 4 Iron.

Returning to FIG. 3, the trajectory T obtained with a club according to the invention is characterized in that it completely exceeds the conical area defined by the generator PP'. The trajectory is as high as that of a short iron whilst being almost as long as that of a long iron. It is also characterized, for a trajectory of this length, by a fairly rapid descent. It is therefore ideal for clearing a high and distant obstacle.

The method recommended for adapting this new club to the morphology of a particular golf player can be explained by a definition of the invention with reference to existing Irons.

For a given player, the club according to the invention corresponds to the following characteristics, in comparison with the set of clubs which suit this golfer and which furthermore he already plays with:

The length L of the club: comprised between the length L of the 4 Iron (face angle of about 26°) and that of the 1 Iron (face angle from 15 to 18°) of the set, typically, the length of the 2 Iron, the face angle of which is of the order of 20°.

The face angle b ("loft") of the club face: equal to or greater than the angle b of the 6 Iron of the set, typically, the angle b of the 7 Iron, for example 36.5°.

The lie angle a: equal to or less than the lie angle of the 6 iron, the face angle of which is about 34°, and preferably equal to or less than the lie angle of the 4 iron the face angle of which is about 26°.

Head mass: equal to or less than that of the 4 iron the face angle of which is about 26°.

The invention also relates to a set of clubs comprising a set which can be the set of traditional irons numbered from 1 to 10 and the "Sand-Wedge", to which is added the club defined as indicated above relative to the set of clubs.

On condition that the construction and assembly of the head, shaft and grip respects the well-known and itemized rules laid down by the Royal and Ancient Golf Society of Saint Andrews (Scotland) and respected throughout the world, the club constituting the invention is perfectly legal. It falls within the philosophy of the game, in effect, that the player should be responsible for the length, the angle of the face and the weight of his clubs, on the condition that a round of golf must not be played with more than fourteen clubs in one's bag.

What is claimed is:

1. A golf club belonging to the category of irons and comprising a shaft (6) to one end of which a head (4) is fixed having a permanently defined face angle (b) greater than 35° between a striking face of said head and a plane (V) containing a longitudinal axis (7) of said shaft (6) and parallel to a lower edge (12) of the striking face (11), wherein said club has along the axis (7) of the shaft (6) a length (L) greater than or equal to 0.99 m, and wherein the head has a mass less than or equal to 0.260 kg.

2. A golf club according to claim 1, wherein said face angle (b) is greater than or equal to 36.5°.

3. A golf club according to claim 1, wherein the shaft axis forms a lie angle (a) of less than 62° with the lower edge (12) of the striking face (11).

4. A golf club according to claim 3, wherein the lie angle (a) is at most equal to approximately 60°.

5. A golf club according to claim 3, wherein the lie angle (a) is less than or equal to 59°.

6. A golf club according to claim 1, wherein the shaft (6) is made from metal, and the head mass is less than 0.255 kg.

7. A golf club according to claim 1, wherein the shaft (6) is made of composite material.

8. A golf club according to claim 1, wherein the face angle (b) is greater than or equal to 36.5°.

9. A collection of golf clubs belonging to the category of irons, including a specific golf club comprising a shaft (6) to one end of which a head (4) is fixed having a permanently defined face angle (b) greater than 35° between a striking face of said head and a plane (V) containing a longitudinal axis (7) of said shaft (6) and parallel to a lower edge (12) of the striking face (11), and wherein said specific club has along the axis (7) of the shaft (6) a length (L) greater than or equal to 0.99 m, and a head mass less than or equal to 0.260 kg.

10. A collection according to claim 9, wherein the face angle (b) of said specific golf club is greater than or equal to 36.5°.

11. A collection according to claim 9, wherein the shaft axis of said specific golf club forms a lie angle (a) of less than 62° with the lower edge of the striking face (11).

12. A collection according to claim 11, wherein the lie angle of said specific golf club is at most equal to approximately 59°.

13. A collection according to claim 9, wherein the shaft (6) of said specific golf club is made from metal, and the head mass is less than 0.255 kg.

14. A collection according to claim 9, wherein the shaft (6) of said specific golf club is made of composite material.

15. A golf club belonging to the category of irons and comprising a shaft (6) to one end of which a head (4) is fixed having a permanently defined face angle (b) greater than 35° between a striking face of said head and a plane (V) containing a longitudinal axis (7) of said shaft (6) and parallel to a lower edge (12) of the striking face (11), wherein said club has along the axis (7) of the shaft (6) a length (L) greater than or equal to 0.99 m, and wherein the shaft axis forms a lie angle (a) of less than 62° with the lower edge (12) of the striking face (11).

16. A golf club according to claim 15, wherein said face angle (b) is greater than or equal to 36.5°.

17. A golf club according to claim 15, wherein the lie angle (a) is at most equal to approximately 60°.

18. A golf club according to claim 15, wherein the lie angle (a) is less than or equal to 59°.

* * * * *